US009868024B2

(12) United States Patent
Castelluccio

(10) Patent No.: US 9,868,024 B2
(45) Date of Patent: Jan. 16, 2018

(54) ABDOMINAL AND OBLIQUE EXERCISE DEVICE

(71) Applicant: Salvatore Castelluccio, Coraopolis, PA (US)

(72) Inventor: Salvatore Castelluccio, Coraopolis, PA (US)

( * ) Notice: Subject to any disclaimer, the term of this patent is extended or adjusted under 35 U.S.C. 154(b) by 239 days.

(21) Appl. No.: 15/015,489

(22) Filed: Feb. 4, 2016

(65) Prior Publication Data

US 2016/0228740 A1 Aug. 11, 2016

Related U.S. Application Data

(60) Provisional application No. 62/112,207, filed on Feb. 5, 2015.

(51) Int. Cl.
*A63B 21/045* (2006.01)
*A63B 23/02* (2006.01)
(Continued)

(52) U.S. Cl.
CPC ..... *A63B 23/0211* (2013.01); *A63B 21/023* (2013.01); *A63B 21/0428* (2013.01); *A63B 21/4033* (2015.10); *A63B 21/4035* (2015.10); *A63B 21/4045* (2015.10); *A63B 23/03525* (2013.01); *A63B 21/00061* (2013.01); *A63B 21/026* (2013.01); *A63B 21/05* (2013.01);
(Continued)

(58) Field of Classification Search
CPC ... A63B 25/08; A63B 21/008; A63B 21/0083; A63B 21/0087; A63B 23/02–23/0227; A63B 21/0428; A63B 21/023; A63B 23/03525; A63B 21/4033; A63B 21/4035; A63B 21/4039; A63B 21/4045; A63B 21/00061; A63B 21/05; A63B 21/026; A63B 2210/50; A63B 2208/0233; A63B 2023/0411; A63B 23/1209; A63B 2023/003
See application file for complete search history.

(56) References Cited

U.S. PATENT DOCUMENTS 1,916,714 A * 7/1933 Burke ..... A63B 21/0083 482/112
3,447,415 A * 6/1969 Kime ..... G09B 15/06 267/177
(Continued)

*Primary Examiner* — Gregory Winter
(74) *Attorney, Agent, or Firm* — Blynn L. Shideler; Krisanne Shideler; BLK Law Group

(57) ABSTRACT

An abdominal and oblique exercise device is formed as a small, lightweight portable structure and configured to be used while in the sitting position. The device includes leg or thigh grips that engage the user's thighs and handlebars that are engaged by the user's hands. The leg grips are coupled to a stationary cylindrical main body member and the main body member includes three distinct grooves defining three distinct exercise movements. The handlebars are coupled to a moveable top piston received within the main body member. The piston includes a groove following projection that is selectively received in one of the three grooves in the main body member. The movement of the top piston relative to the bottom main body member will compress a resistance spring for resistance throughout the exercise. The grooves will define proper user movement for exercising to isolate the desired muscles.

20 Claims, 7 Drawing Sheets

(51) Int. Cl.

| | |
|---|---|
| ***A63B 21/00*** | (2006.01) |
| ***A63B 23/035*** | (2006.01) |
| ***A63B 21/04*** | (2006.01) |
| *A63B 23/00* | (2006.01) |
| *A63B 23/12* | (2006.01) |
| *A63B 23/04* | (2006.01) |
| *A63B 21/02* | (2006.01) |
| *A63B 21/05* | (2006.01) |

(52) U.S. Cl.
CPC ..... *A63B 21/4039* (2015.10); *A63B 23/0216* (2013.01); *A63B 23/1209* (2013.01); *A63B 2023/003* (2013.01); *A63B 2023/0411* (2013.01); *A63B 2208/0233* (2013.01); *A63B 2210/50* (2013.01)

(56) References Cited

U.S. PATENT DOCUMENTS 4,129,297 A * 12/1978 Dolan ..... A63B 21/04 482/123
4,390,178 A * 6/1983 Rudell ..... A63B 25/08 482/77
5,071,119 A 12/1991 Johnson
5,154,685 A * 10/1992 Chen ..... A63B 21/00043 482/121
5,222,580 A * 6/1993 Wang ..... A63B 21/0083 188/321.11
5,232,425 A 8/1993 Miller et al.
5,759,138 A 6/1998 Boland
6,056,676 A 5/2000 Adams
6,296,598 B1 10/2001 Boland
6,494,819 B1 12/2002 Boland
6,616,582 B1 9/2003 Jiang
6,814,690 B1 11/2004 Stearns
6,939,277 B2 9/2005 Tuller et al.
7,008,356 B2 3/2006 Hung
7,306,547 B2 12/2007 Stearns
D604,373 S 11/2009 Dalebout et al.
7,614,989 B1 11/2009 Wu
7,618,357 B2 11/2009 Dalebout et al.
D608,401 S 1/2010 Campanaro et al.
7,645,217 B2 1/2010 Habing et al.
7,658,701 B2 2/2010 Webb et al.
D612,000 S 3/2010 Campanaro et al.
7,674,209 B2 * 3/2010 Greene ..... A63B 21/00185 482/121
D613,351 S 4/2010 Splane
7,713,181 B1 5/2010 Durham
7,749,144 B2 7/2010 Hammer
7,775,950 B2 8/2010 Campanaro et al.
7,780,585 B1 8/2010 Rivas
7,803,097 B2 9/2010 Araujo
7,819,788 B1 10/2010 Ho et al.
7,857,741 B1 12/2010 Hsiung
D631,108 S 1/2011 Brodess et al.
7,892,147 B2 2/2011 Vick, Jr.
7,927,267 B2 4/2011 Splane
7,938,763 B2 5/2011 Campanaro et al.
7,951,048 B1 5/2011 Hsiung
D641,434 S 7/2011 Khubani
7,998,039 B1 8/2011 Wallach
8,002,683 B1 8/2011 Nayebdadash
8,016,731 B2 9/2011 Vanterpool
8,062,196 B1 9/2011 Khubani
D649,205 S 11/2011 Zachary
8,075,457 B2 12/2011 Campanaro et al.
D652,461 S 1/2012 Brodess et al.
8,096,929 B2 1/2012 Habing et al.
8,105,221 B2 1/2012 Splane
8,118,718 B2 2/2012 Brodess et al.
8,118,720 B2 2/2012 Sebastian
D655,357 S 3/2012 Casey et al.
8,210,998 B2 7/2012 Chen et al.
D671,177 S 11/2012 Sip
D671,178 S 11/2012 Sip
8,317,668 B2 11/2012 Sales et al.
8,323,160 B2 12/2012 Splane
8,353,808 B1 1/2013 Barney
8,550,965 B2 10/2013 Candela et al.
8,708,874 B2 4/2014 Chen
8,727,955 B2 5/2014 Huang
2002/0188236 A1 * 12/2002 Lin ..... A61H 9/0078 601/107
2013/0005542 A1 * 1/2013 Wu ..... A63B 21/05 482/128

* cited by examiner

ABDOMINAL AND OBLIQUE EXERCISE DEVICE

RELATED APPLICATIONS

This application claims priority to U.S. provisional patent application Ser. No. 62/112,207 filed Feb. 5, 2015, invented by Salvatore Castelluccio, entitled "Abdominal and Oblique Exercise Device" which is incorporated herein by reference in its entirety.

BACKGROUND OF THE INVENTION

Field of the Invention

The present invention relates to an abdominal and oblique exercise device, and more particularly to a small, lightweight portable structure and configured to be used while in the sitting position and guiding the user through at least three distinct exercise motions.

Background Information

The history of fitness goes back to early man's need for physical strength and speed while hunting. As the centuries carried on and individual cultures developed, human beings became more sedentary. This lead to an interest in fitness not as a necessity of survival, but as an important aspect of a long, healthy life. Exercise equipment has been key to this change, helping generations of people from around the world shape and condition their bodies. Although bodyweight, calisthenics and yoga-based exercises were practiced by the ancient Egyptians, Chinese, Indians and other cultures, the ancient Greeks are often credited with developing the earliest forms of modern exercise equipment, namely weight training equipment. According to legend, Milo of Croton, an Olympic wrestler of renown in $6^{th}$ century BC, trained by lifting and carrying a newborn calf and repeating the feat daily as it grew to maturity. One of the first documented "free weights" used in athletic training were "halteres", or hand-held weights with a hole for gripping rather than a handle, which were used as early as the fifth century B.C. Illustrations of early Greece show muscular men using dumbbells, weight plates and plummets to train for physical strength.

Skipping ahead a few millenniums, modern exercise equipment has become ubiquitous and specialized. One area of specialization is equipment concentrating on exercising the rectus abdominis muscles, the external oblique muscles, the internal oblique muscles, and the transverse abdominal muscles which is commonly referenced as abdominal and oblique exercise equipment. The present invention described herein is directed to a small, lightweight portable structure and configured to be used while in the sitting position and guiding the user through at least three distinct abdominal and oblique exercise motions.

The prior art patent literature, some of which are discussed below in greater detail, has disclosed a number of abdominal exercise devices which are formed as a small, lightweight portable structure and configured to be used while in the sitting position. The prior art devices include leg grips that engage the user's thighs and handlebars that are engaged by the user's hands and/or chest. The leg grips of many prior art devices are coupled to a stationary base member and the handlebars are coupled to a moveable cylinder top received within the base member wherein the movement of the top relative to the bottom will compress a resistance spring for resistance throughout the exercise. These devices do not efficiently or effectively isolate the muscle groups.

Regarding the prior art patent literature for abdominal exercisers U.S. Pat. No. 7,819,788 discloses an exercising apparatus for exercising the muscles of the limbs, waist and abdomen which includes an upright support with a pulley at the top, a handlebar with two grips arranged at the top and a middle part formed of a spring member, a linking device, which has a top end pivotally connected to the bottom end of the handlebar, a middle part pivotally connected to a lower part of the support and a bottom end pivotally mounted with two foot bars, and an expander extending over the pulley of the upright support and connected to between the handlebar and the support.

U.S. Pat. No. 7,306,547 discloses an abdominal exercise device that includes a frame, and upper and lower force receiving members movably mounted on respective portions of the frame and constrained to move in opposite directions. A person using the device is required to stabilize the device while seated on a conventional chair. A resistance device is interconnected between the frame and at least one of the force receiving members to resist movement of the members toward one another and/or to bias the members away from one another. The lower member is configured to support a person's feet, and the upper member is configured to support a person's hands and/or to engage a person's chest.

U.S. Pat. No. 7,008,356 discloses an exercising device which includes a main body, two handles, a support rod, a resting board, a connecting lever, and a rotation body. The main body includes two casings, a slide, and an elastic member. The rotation body includes a pivot ring secured on the connecting lever, a first disk mounted for rotation on the pivot ring, a second disk mounted for rotation on the pivot ring and combined with the first disk so that the pivot ring is located between the first disk and the second disk, and a counterweight mounted between the first disk and the second disk to rotate therewith. The exercising device is suggested to be used to exercise a user's arms, waist and abdomen simultaneously.

U.S. Pat. No. 6,939,277 discloses an abdominal exercise device that comprises a semi-rigid member, an upper member and a lower member, wherein the upper member and the lower member couple to the semi-rigid member, the upper member and lower member can be securely or detachably attachable to the semi-rigid member while the lower member can have pivoting capabilities.

U.S. Pat. No. 6,814,690 discloses an abdominal exercise device which includes a frame, and upper and lower force receiving members movably mounted on the frame and constrained to move in opposite directions. A resistance device is interconnected between the frame and at least one of the force receiving members to resist movement of the members toward one another and/or to bias the members away from one another. The lower member is configured to support a person's feet, and the upper member is configured to support a person's hands and/or to engage a person's chest.

U.S. Pat. No. 6,616,582 discloses an abdominal exerciser that has a pressing board, a shaft, a main body, a rotating disk, a bowl, a pair of connecting sleeves, and a pair of handle bars. The main body has an outer ring, and a main tube having a cross-shaped groove. The pressing board is disposed on the shaft. The shaft is inserted through the main tube. A compression spring is disposed between the pressing board and the outer ring to surround the shaft. A connecting rod is connected to the shaft. A connector is connected to an end of the connecting rod. A post is disposed on the connecting rod. The bowl is disposed on the connector. The rotating disk has an annular center flange to engage with the bowl. The connecting sleeves are disposed on the outer ring to receive the handle bars.

U.S. Pat. No. 6,494,819 discloses a combined abdominals (main and lower abs)/thighs/calves exercise device, which composes a base support member assembly upon which the user sits, a partially vertical and horizontal resistance mast with resilient restorative properties mounted upon the base support member support, and a collar oriented upon the upper mast. A bracket means is reciprocally mounted upon the collar and is adapted to hold a range of vertical positions along same. A pair of gripped bars transversely mounted upon the outer end of bracket means, which bars permit the user to train and strengthen major and minor muscle sets dependent upon the physical orientation of the gripped bars.

U.S. Pat. No. 6,296,598 discloses a portable, lap-based multi-exercise device which includes a first pair of elongate parallel members forming a base component and defining a trough for receiving the lever end of a traveling spanner bar; a pair of pivoted, upstanding lateral side bars attached at their lower ends to the torso-oriented, longitudinal ends of the trough; a first cross bar is connected pivotally to the upper ends of the side members and is adapted to receive either manual or user chest exertion, while is translated to the upper end of the spanner bar which then moves outwardly in response to user exertion thereon. A second transverse bar is pinned to the outer end of the trough and provides a second set of manual grips adapted for moving the trough component in an arcuate path towards the first cross members, thereby moving the spanner bar along the trough, to steady the device while user effort is being imposed on the latter component.

U.S. Pat. No. 6,056,676 discloses an exercise device for facilitating the strengthening of abdominal and back muscles, and which includes a resistance member coupled between a lap-engaged base and an arm positioning member. The resistance member resists substantially vertical downward movement relative to the base member to enhance the development of muscle strength by enabling the upper body of the user to contract and expand vertically without leaning forwardly in a safe and effective manner.

U.S. Pat. No. 5,759,138 discloses a portable abdominal and arm exercise device that includes a first pair of elongate parallel rigid members forming a base with an elongate trough therein for receiving one end of a rigid spanning bar, a second pair of upstanding spaced-apart rigid members attached at their lower ends to the first pair of elongate parallel rigid members and attached at their upper ends to one end of a cross bar. The cross-bar is attached at its other end to the rigid spanning bar.

U.S. Pat. No. 5,232,425 discloses a device for exercising the abdominal muscles which facilitates movement of the lower torso against a resistive force and in a complex arc which conforms to the normal forward arc of rotation of the spine.

U.S. Pat. No. 5,071,119 discloses an exercise device for exercising abdominal muscles and lower back muscles which includes a push-bar supported on a vertical column including a compression spring means. The user curls his trunk against the resistive force, holds it for a second, twists to the right and left, and then very slowly allows the resistive force to push the trunk upward to resume the original upright position.

The above cited patents is definitely not an exhaustive listing of patents in this crowded art, as all of the following issued patents from the last five years disclose "Abdominal Exercise Devices": U.S. Pat. Nos. 8,727,955; 8,708,874; 8,550,965; 8,353,808; 8,323,160; 8,317,668; D671,178; D671,177; 8,210,998; D655,357; 8,118,720; 8,118,718; 8,105,221; D652,461; 8,096,929; 8,075,457; D649,205; 8,062,196; 8,016,731; 8,002,683; 7,998,039; D641,434; 7,951,048; 7,938,763; 7,927,267; 7,892,147; D631,108; 7,857,741; 7,803,097; 7,780,585; 7,775,950; 7,749,144; 7,713,181; D613,351; D612,000; 7,658,701; D608,401; 7,645,217; D604,373; 7,618,357; and 7,614,989. All of the patents cited herein are incorporated herein by reference and provide excellent background in the construction and operation of abdominal exercise devices in general.

With this background it becomes clear that there remains a need for exercise equipment in general and abdominal exercise equipment in particular. Further there remains a need for a small, lightweight portable structure and configured to be used while in the sitting position and guiding the user through at least three distinct abdominal and oblique exercise motions.

SUMMARY OF THE INVENTION

The present invention addresses the deficiencies of the prior art and provides a small, lightweight portable abdominal and oblique exercise device configured to be used while in the sitting position.

One summary of the present invention is that it provides an abdominal and oblique exercise device including A) at least one lower grip configured to engage the user's lower extremity below the user's waist; B) at least one upper grip configured to engage the user's upper extremity above the user's waist; C) a cylindrical main body member and coupled to the at least one lower grip; D) a piston received and configured to reciprocate within the main body member, the piston coupled to the at least one upper grip; E) At least one resistance member providing resistance in the reciprocation movement of the piston within the main body member in at least one direction of piston movement; F) at least two distinct grooves within one of the cylindrical main body member or the piston and each groove associated with a distinct exercise movement of the user; and G) a groove following projection on one of the cylindrical main body member or the piston opposite from the grooves and wherein the groove following projection is selectively received in one of the grooves in the main body member and wherein the groove following projection is configured to follow the groove that is associated with the distinct exercise movement of the user while the user performs the distinct exercise movement of the user with the exercise device.

The device the invention may be described as including leg or thigh grips that engage the user's thighs and handlebars that are engaged by the user's hands. The leg grips are coupled to a stationary cylindrical main body member and the main body member includes three distinct grooves defining three distinct exercise movements. The handlebars are coupled to a moveable top piston received within the main body member. The piston includes a groove following projection that is selectively received in one of the three grooves in the main body member. The movement of the top piston relative to the bottom main body member will compress a resistance spring for resistance throughout the exercise. The grooves will define proper user movement for exercising to isolate the desired muscles.

These and other advantages are described in the brief description of the preferred embodiments in which like reference numeral represent like elements throughout.

DESCRIPTION OF THE PREFERRED EMBODIMENTS

Figures 1A, 1B:
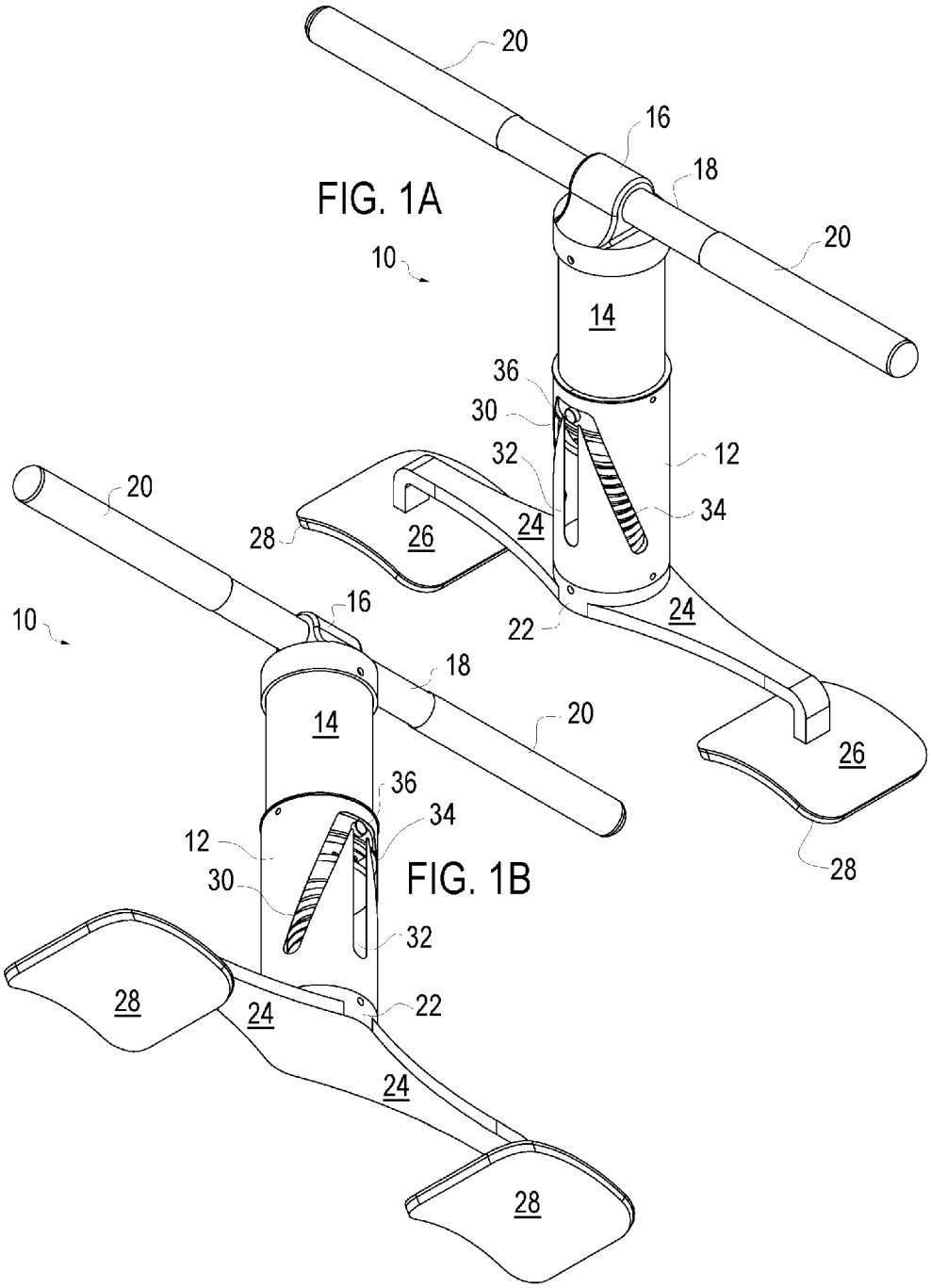
FIG. 1A is a top front perspective view of an abdominal and oblique exercise device according to one embodiment of the present invention.
FIG. 1B is a bottom front perspective view of the abdominal and oblique exercise device of FIG. 1A.
Figure 2A:
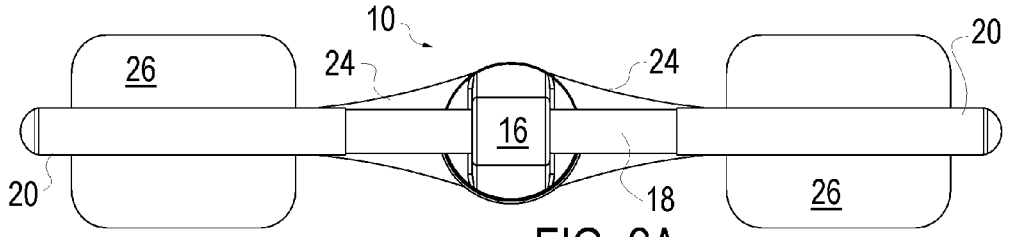
FIG. 2A is a top plan view of the abdominal and oblique exercise device of FIG. 1A.
Figure 2B:
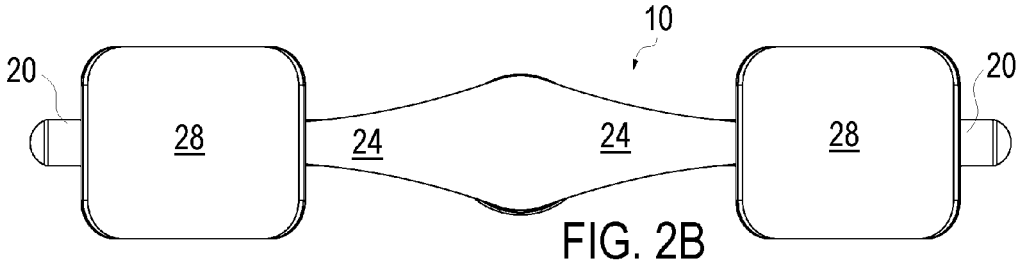
FIG. 2B is a bottom plan view of the abdominal and oblique exercise device of FIG. 1A.
Figure 2C:
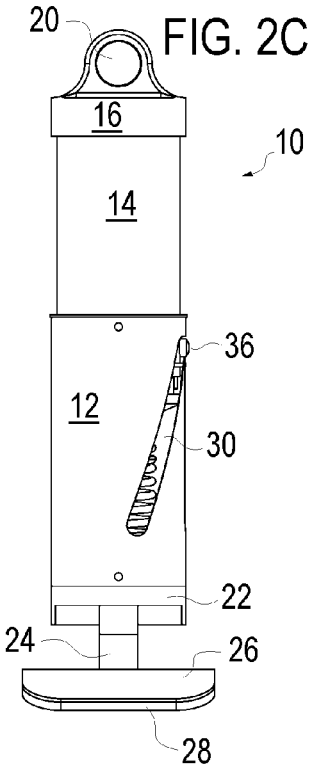
FIG. 2C is a side elevation view of the abdominal and oblique exercise device of FIG. 1A.
Figure 2D:
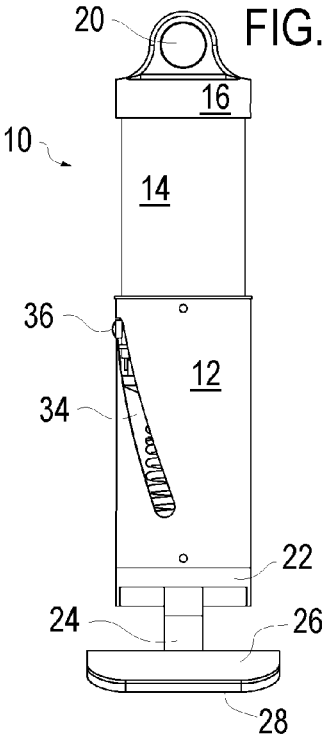
FIG. 2D is an opposite side elevation view of the abdominal and oblique exercise device of FIG. 1A.
Figure 3A:
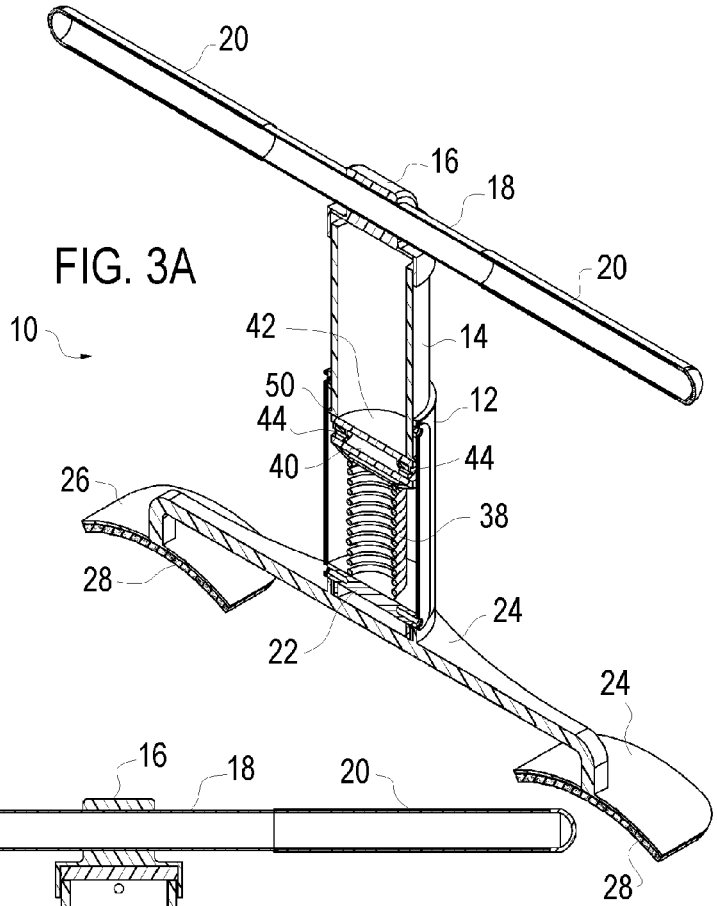
FIG. 3A is a perspective section view, along a side to side medial section plane, of the abdominal and oblique exercise device of FIG. 1A.
Figure 3B:
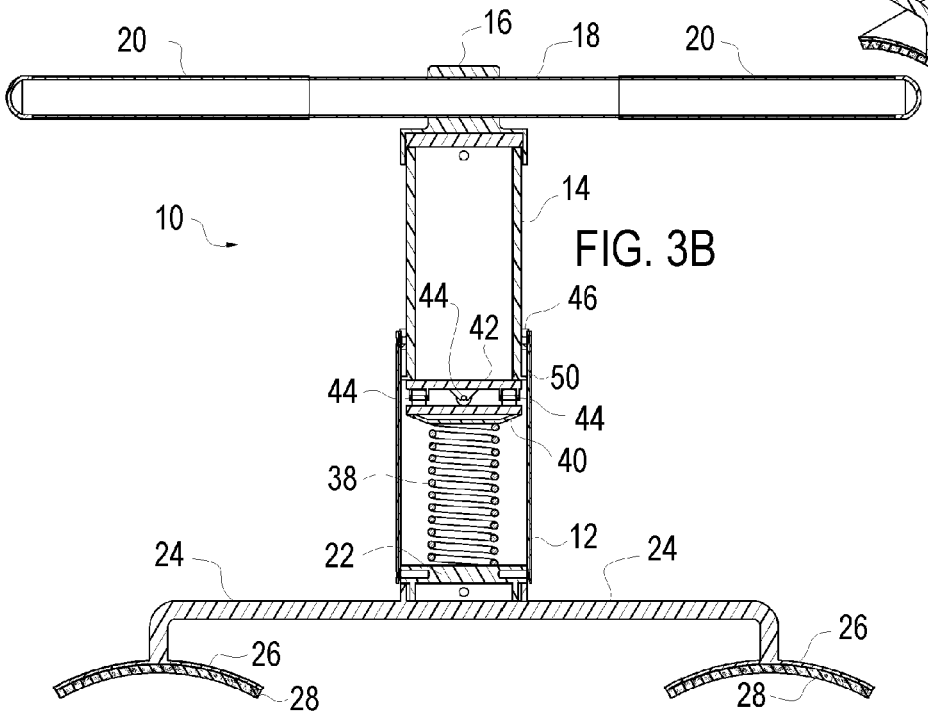
FIG. 3B is a front elevation section view, along a side to side medial section plane, of the abdominal and oblique exercise device of FIG. 1A.
Figure 3C:
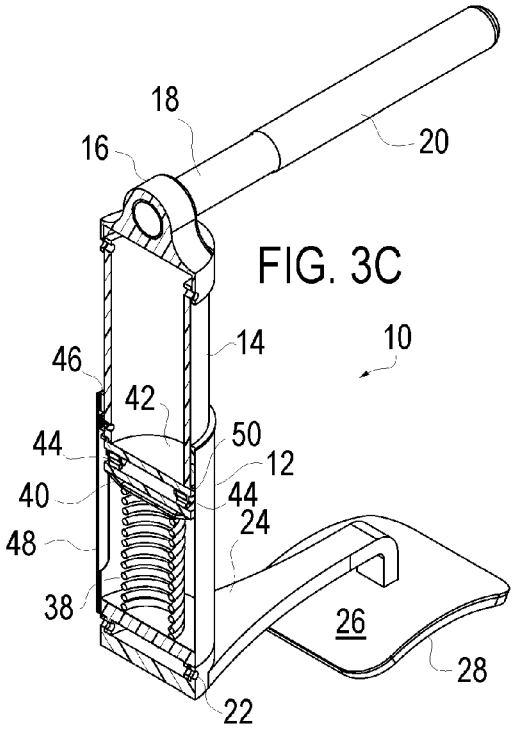
FIG. 3C is a perspective section view, along a front to rear medial section plane, of the abdominal and oblique exercise device of FIG. 1A.
Figure 3D:
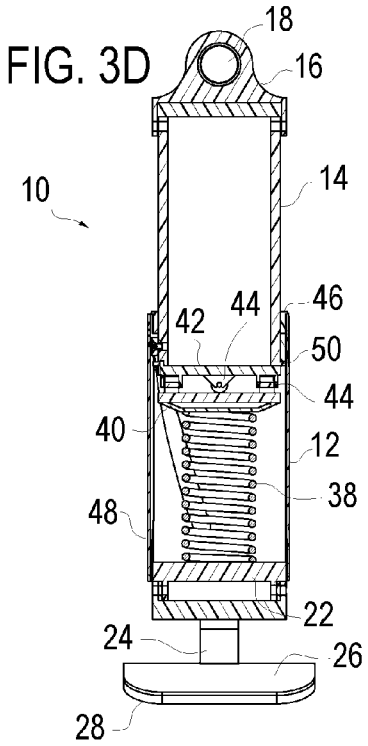
FIG. 3D is a side elevation section view, along a front to rear medial section plane, of the abdominal and oblique exercise device of FIG. 1A.

As FIGS. 1A and B are perspective views of an abdominal and oblique exercise device 10 according to one embodiment of the present invention. As described in detail below the abdominal and oblique exercise device 10 of the invention provides a small, lightweight portable abdominal and oblique exercise device configured to be used while in the sitting position, wherein the abdominal and oblique exercise device 10 defines proper user movement for exercising to isolate the desired muscles through at least three distinct user movements/exercises.

The abdominal and oblique exercise device 10 includes a main body cylinder 12 (or main body member 12) that receives a top piston 14 therein that moves relative to the member 12 to define the user's exercise motion, as will be clarified below. The member 12 and the piston 14 may be made of any conventional material suitable for use as exercise equipment; however plastic compositions will likely yield a sufficiently durable structure and be lightweight and easily manufactured.

A piston cap 16 is coupled to the top end of the piston 14 and receives a handle 18 there there-through at an upper end. As noted in the summary of the invention the abdominal and oblique exercise device 10 includes at least one upper grip configured to engage the user's upper extremity above the user's waist, and in the embodiment illustrated this structure is formed by the handle 18. The piston cap 16 may be coupled to the piston 14 in any conventional fashion such as glue, sonic welding, set screws or the like. The handle 18 may be coupled to the piston cap in any similar fashion, or merely a friction fit. The use of set screw, or other fastener attachment, or friction fit attachment arrangement of the handle 18 to the piston cap 16 can allow for the user to easily disassemble the device 10 for transport (e.g. in the user's luggage for travel). The handle 18 and cap 16 may be made of any suitable materials as discussed above. Combinations of distinct materials are also possible, generally as manufacturing costs suggest. User grips 20 are provided on the ends of the handle 18, which may be rubber, foam or plastic and may include molded finger recesses as known in the grip art. User grips 20 may be easily coupled via friction fit, but adhesives and/or set screws or other mechanical fasteners may be utilized.

A cylinder base 22 is coupled to the bottom of the main body member 12. The cylinder base 22 includes a pair of base legs 24 that extend to thigh plates 26. Foam or rubber thigh pads 28 are coupled to the thigh plates. As noted in the summary of the invention the abdominal and oblique exercise device 10 includes at least one lower grip configured to engage the user's lower extremity below the user's waist, and in the embodiment illustrated this structure is formed by the base 22, base legs 24, thigh plates 26 and thigh pads 28. The cylinder base 22, legs 24 and plates 26 may be formed of conventional materials, such as plastic as discussed above and coupled in any conventional fashion as discussed above. Additionally some of the individual components may be combined together and molded together as a single unit. The foam or rubber thigh pads 28 may be easily adhesively coupled to the thigh plates. The thigh pads 28 will be engaged against a user's thighs during exercise with the device 10. The cylinder base 22 may be coupled to the to the bottom of the main body member 12 in a user releasable manner, such as threads, or twist-on locking ears or lug elements, a snapping connection, or other known releasable connections. The releasable connection will allow the user to access the interior of the main body member 12 to customize the abdominal and oblique exercise device 10 for the user by adjusting the tension.

A key aspect of the present invention is the provision of three grooves 30, 32 and 34 in the main body cylinder 12, wherein each groove 30, 32 or 34 defines the proper movement of user during a distinct exercise as will be described below. The piston 14 includes a peg, or groove following projection 36 extending there from and received within the grooves 30, 32 and 34. As shown in the figures the top of the grooves 30, 32 and 34 overlap to form a common area such that the projection 36 can be moved to follow one of the three grooves 30, 32 or 34 as the user desires. Alternatively, the groove following projection 36 and the associated grooves 30, 32 or 34 may be switched or positioned on the main body cylinder 12 and the piston 14, respectively, and generally operate in a similar manner.

In order to provide resistance to the user during exercise the device 10 includes at least one resistance member providing resistance in the reciprocation movement of the piston 14 within the main body member 12 in at least one direction of piston movement, which member is effectively formed in the embodiment shown by a resistance spring 38 within the main body member 12, generally mounted on a top surface of the base 22 as shown in sectional views 3A-D. As noted below the spring 38 is releasable coupled to the base 22 to allow for user replacement of the spring 38. A coil spring, as shown can provide an effective and efficient spring, although other spring elements are possible such as a leaf spring or compression element. The resistance characteristics of the spring 38 will be generally constant throughout the exercise movement, but the manufacturer may select an alternative force increasing spring response curve if desired. Further it is anticipated that the manufacturer may have versions with increasing resistance. With cylinder base 22 coupled to the to the bottom of the main body member 12 in a user releasable manner, the user may be provided with substitute springs 38 of varying tension characteristics to allow for the user to vary the tension for varied resistance in the user's work outs by completely replacing the spring 38 with an alternative substitute spring 38 of desired characteristics.

The top of the spring 38 is provided with a cone and plate member 40. The piston 14 includes a lower piston base plate 42 and four piston wheels 44 are coupled to the base plate 42 and ride upon the cone and plate member 40. The wheels 44 allows the piston 14 (and associated structure) to easily move rotationally relative to the main body cylinder 12 and associated structure, such as during the exercises associated with grooves 30 and 34 or movement between grooves 30, 32 and 34.

The device 10 includes an annular retaining rib 46 extending on the inside of the cylinder 12 and which serves to hold the piston 14 (and associated structure) coupled to the cylinder 12. An outwardly extending lip 50 on the piston 14 also serves to maintain the device together at the top of the relative motion. Further the device includes a front shield 48 covering the three grooves 30, 32 and 34 and projection 36 for the user's protection and to prevent unwanted jamming of the device 10. The shield is only shown in two figures and is omitted for clarity. The shield 48 is preferably transparent at the top thereof such that the user will at least be able to view the position of the projection 36 relative to the three grooves 30, 32 and 34 as the user selects a desired exercise (associated with the projection following one groove 30, 32 or 34). The shield 48 is preferably opaque below the upper common portions of the grooves 30, 32 and 34 so as to obscure the inner working of the device 10 as may be desirable. However, the shading of the shield 48 relative to the three grooves 30, 32, and 34 below the upper common portions of the grooves should be light enough in color to allow for visibility of a projection 36 throughout the three grooves 30, 32, 34. The projection 36 may be bright colored.

In operation, the user places the thigh pads 28 to engage the user's quadriceps and the grips 20 of the handle 18 is engaged by the user's hands. The users palms will face toward them and their elbows are typically bent and tucked at their sides. The handle 18 will be at the approximate height of their chest. Using only their abdominal and oblique muscles the user will force the piston 14 (and associated structures) down relative to the main body cylinder 12 (and associated structure). The projection 36 will follow one groove 30, 32 or 34 defining one of three distinct exercise movements. The movement of the top piston 14 relative to the bottom main body member 12 will compress a resistance spring 38 for resistance throughout the exercise. The projection 36 within one of the grooves 30, 32 or 34 will define proper user movement for exercising to isolate the desired muscles.

In order to isolate the lower abdominal and oblique muscles the user can also perform the three distinct motions by leaning back slightly and bringing their quadriceps up toward their hands, again using only their abdominal and oblique muscles to move the device 10 (in which case the main body member 12 is moved relative to the stationary cylinder 14).

Figure 4A:
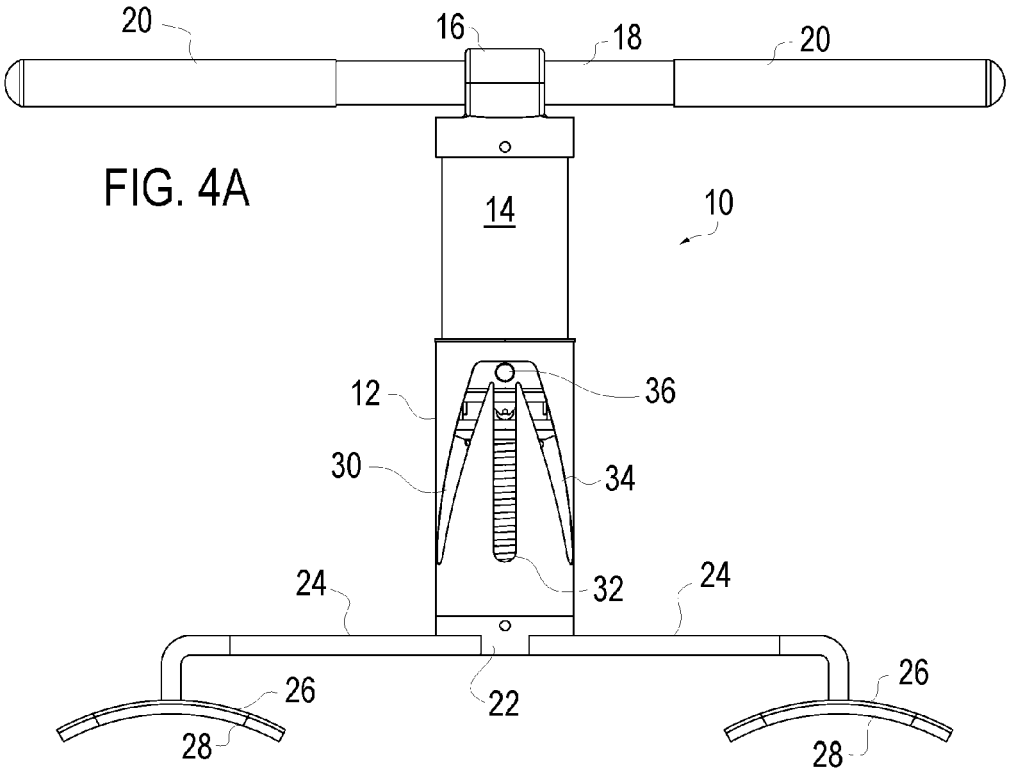
FIG. 4A is a front elevation view of the abdominal and oblique exercise device of FIG. 1A.
Figure 4B:
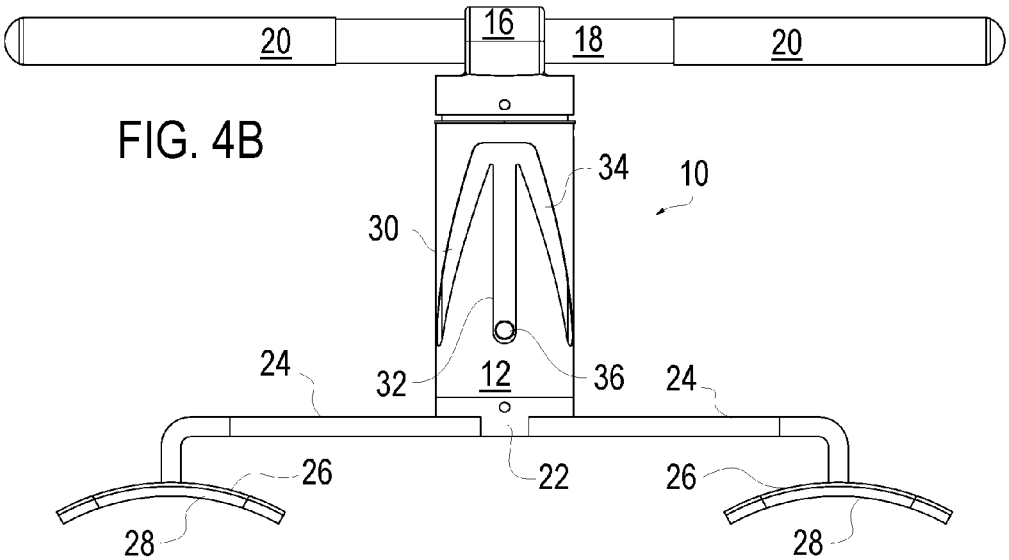
FIG. 4B is a front elevation view of the abdominal and oblique exercise device of FIG. 1A, showing the device in a compressed position for a first abdominal exercise.
Figure 5A:
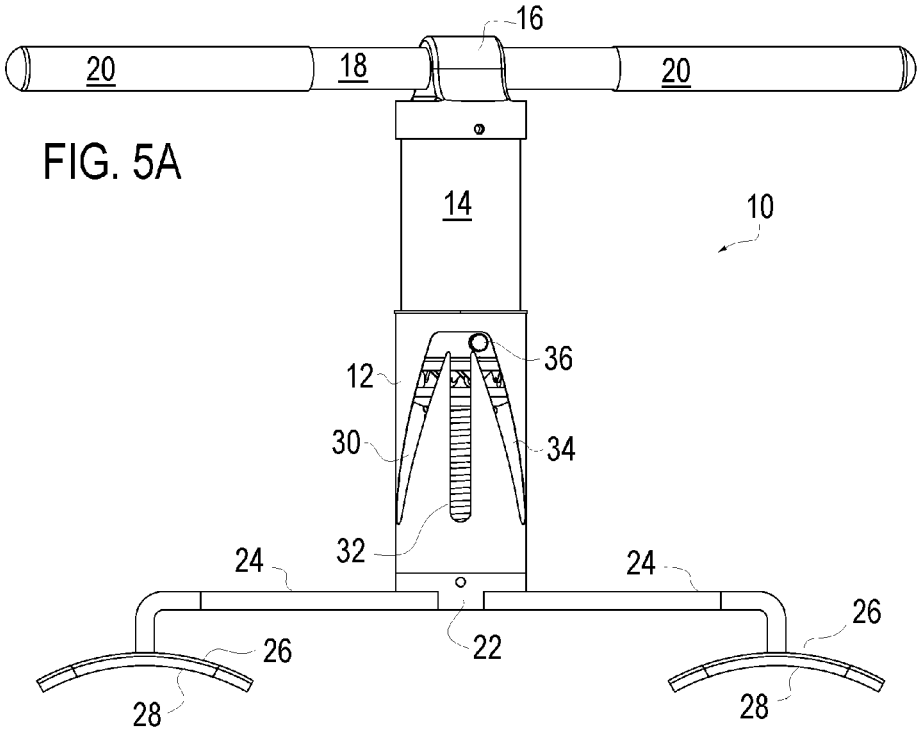
FIG. 5A is a front elevation view of the abdominal and oblique exercise device of FIG. 1A, showing the device in a position for beginning a second abdominal exercise and first oblique exercise.
Figure 5B:
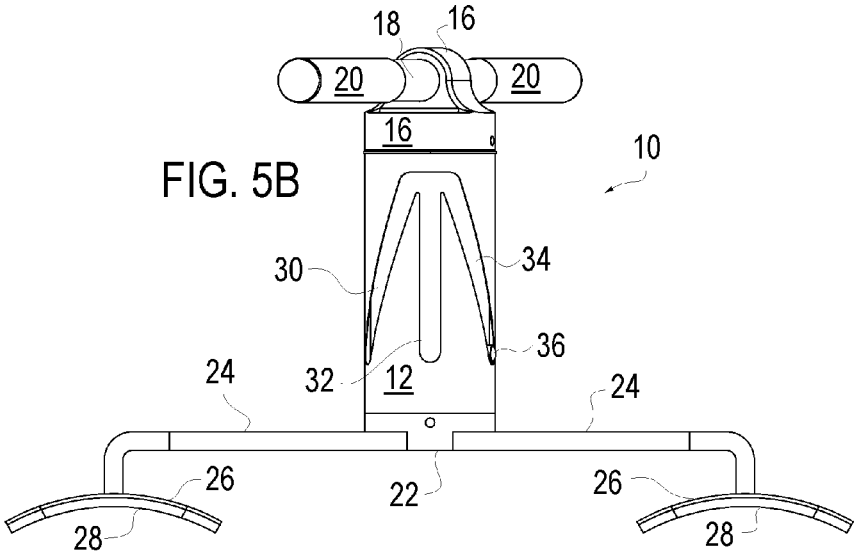
FIG. 5B is a front elevation view of the abdominal and oblique exercise device of FIG. 1A, showing the device in a compressed position for the second abdominal exercise and first oblique exercise.
Figure 6A:
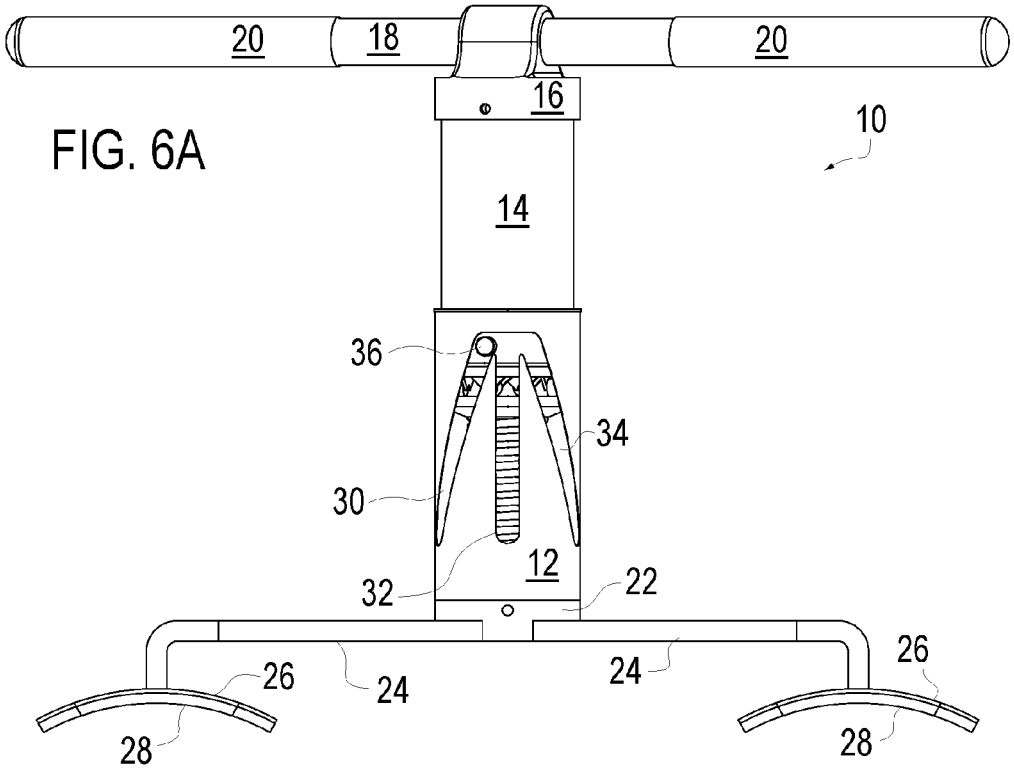
FIG. 6A is a front elevation view of the abdominal and oblique exercise device of FIG. 1A, showing the device in a position for beginning a third abdominal exercise and second oblique exercise.
Figure 6B:
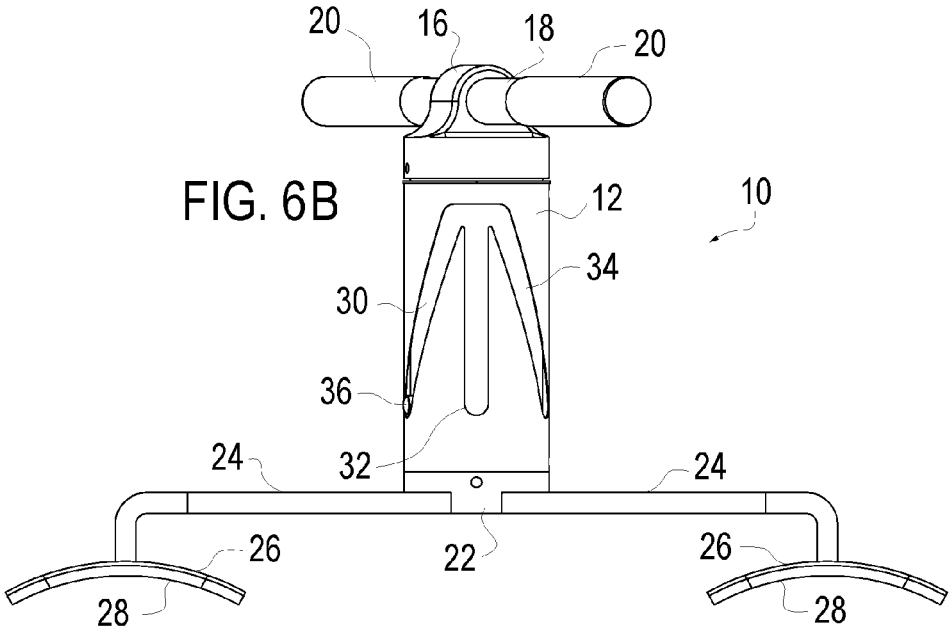
FIG. 6B is a front elevation view of the abdominal and oblique exercise device of FIG. 1A, showing the device in a compressed position for the third abdominal exercise and second oblique exercise.

FIGS. 4A-B, 5A-B and 6A-B illustrate the range of motion for the three exercise movements. FIGS. 4A and B show movement of the cylinder 14 relative to the base member 12 along groove 32, in which motion there is no torsional movement of the user's torso relative to the leg position. FIGS. 5A and B show movement of the cylinder 14 relative to the base member 12 along groove 34, in which motion there is a torsional movement of the user's torso relative to the leg position. FIGS. 6A and B show movement of the cylinder 14 relative to the base member 12 along groove 30, in which motion there is a torsional movement of the user's torso relative to the leg position opposite from the twist associated with groove 34.

The preferred embodiments described above are illustrative of the present invention and not restrictive hereof. It will be obvious that various changes may be made to the present invention without departing from the spirit and scope of the invention. The precise scope of the present invention is defined by the appended claims and equivalents thereto.

What is claimed is:

1. An abdominal and oblique exercise device comprising:

A) at least one lower grip configured to engage the user's lower extremity below the user's waist;

B) at least one upper grip configured to engage the user's upper extremity above the user's waist;

C) a cylindrical main body member coupled to the at least one lower grip;

D) a piston received and configured to reciprocate within the main body member, the piston coupled to the at least one upper grip;

E) at least one resistance member providing resistance in the reciprocation movement of the piston within the main body member in at least one direction of piston movement;

F) at least two distinct grooves within one of the cylindrical main body member or the piston and each groove associated with a distinct exercise movement of the user; and G) a groove following projection on one of the cylindrical main body member or the piston opposite from the grooves and wherein the groove following projection is selectively received in the grooves, and wherein the groove following projection is configured to follow the groove that is associated with the corresponding distinct exercise movement of the user while the user performs the corresponding distinct exercise movement with the exercise device.

2. The abdominal and oblique exercise device according to claim 1 wherein the at least two distinct grooves comprise three grooves and wherein the grooves will define proper user movement for exercising to isolate the desired muscles.

3. The abdominal and oblique exercise device according to claim 2 wherein movement of the cylinder relative to the main body member with the groove following projection selectively received in either of two of the grooves defines a motion including a torsional movement of the piston relative to the main body member and an associated torsional movement of the user's torso relative to the user's leg position.

4. The abdominal and oblique exercise device according to claim 3 wherein the at least one resistance member includes a resistance spring.

5. The abdominal and oblique exercise device according to claim 4 wherein the at least one lower grip includes a cylinder base coupled to a bottom of the main body member and a pair of base legs extend from the cylinder base.

6. The abdominal and oblique exercise device according to claim 5 wherein each base leg extends to a thigh plate with each thigh pad including a thigh pad coupled to the thigh plate.

7. The abdominal and oblique exercise device according to claim 6 wherein the resistance spring is mounted on a top surface of the cylinder base in a user releasable fashion.

8. The abdominal and oblique exercise device according to claim 7 wherein the resistance spring is a coil spring.

9. The abdominal and oblique exercise device according to claim 8 wherein the cylinder base is coupled to the bottom of the main body member in a user releasable manner.

10. The abdominal and oblique exercise device according to claim 8 wherein the upper grip configured to engage the user's upper extremity above the user's waist includes a piston cap coupled to a top end of the piston and wherein the piston cap receives a handle at an upper end.

11. The abdominal and oblique exercise device according to claim 10 wherein the grooves are within the cylindrical main body member and the groove following projection is coupled to the piston.

12. The abdominal and oblique exercise device according to claim 1 wherein movement of the cylinder relative to the main body member with the groove following projection selectively received in at least one of the grooves defines a motion including a torsional movement of the piston relative to the main body member and an associated torsional movement of the user's torso relative to the user's leg position.

13. The abdominal and oblique exercise device according to claim 1 wherein the at least one resistance member includes a resistance spring.

14. The abdominal and oblique exercise device according to claim 13 wherein the at least one lower grip includes a cylinder base coupled to a bottom of the main body member and a pair of base legs extend from the cylinder base.

15. The abdominal and oblique exercise device according to claim 14 wherein each base leg extends to a thigh plate with each thigh pad including a thigh pad coupled to the thigh plate.

16. The abdominal and oblique exercise device according to claim 15 wherein the resistance spring is mounted on a top surface of the cylinder base in a user releasable fashion.

17. The abdominal and oblique exercise device according to claim 16 wherein the resistance spring is a coil spring.

18. The abdominal and oblique exercise device according to claim 17 wherein the cylinder base is coupled to the bottom of the main body member in a user releasable manner.

19. The abdominal and oblique exercise device according to claim 1 wherein the upper grip configured to engage the user's upper extremity above the user's waist includes a piston cap coupled to a top end of the piston and wherein the piston cap receives a handle at an upper end.

20. The abdominal and oblique exercise device according to claim 1 wherein the grooves are within the cylindrical main body member and the groove following projection is coupled to the piston.

* * * * *